US008544196B2

(12) United States Patent
Leo

(10) Patent No.: US 8,544,196 B2
(45) Date of Patent: Oct. 1, 2013

(54) SHOE CHARM HOLDER DEVICE

(76) Inventor: Susan Leo, Newfane, NY (US)

( * ) Notice: Subject to any disclaimer, the term of this patent is extended or adjusted under 35 U.S.C. 154(b) by 357 days.

(21) Appl. No.: 12/859,916

(22) Filed: Aug. 20, 2010

(65) Prior Publication Data

US 2012/0042544 A1 Feb. 23, 2012

(51) Int. Cl.
*A43B 23/00* (2006.01)

(52) U.S. Cl.
USPC ..... 36/136; 36/132; 36/114; 36/134; 36/112; 36/34 R; 36/36 B; 63/21; 63/23; 63/33; 24/3.6; 24/3.1

(58) Field of Classification Search
USPC ..... 36/112, 34 R, 36 B–36 C, 65, 132, 36/136, 114, 134; 63/21, 23, 33, 40; 24/3.6, 24/3.1
See application file for complete search history.

(56) References Cited

U.S. PATENT DOCUMENTS 979,361 A * 12/1910 Vulpescu ..... 36/34 R
1,414,748 A * 5/1922 Palmer ..... 267/268
1,919,095 A * 7/1933 De Gennaro ..... 428/432
2,096,335 A * 10/1937 Nicholas ..... 411/180
2,139,885 A * 12/1938 De Gironimo ..... 36/42
2,470,200 A * 5/1949 Wallach ..... 36/33
2,689,417 A * 9/1954 Bernstein ..... 36/59 R
2,723,344 A * 11/1955 Greminger ..... 362/439
3,354,561 A * 11/1967 Cameron ..... 36/134
3,722,565 A * 3/1973 Miller et al. ..... 411/180
3,893,247 A * 7/1975 Dana, III ..... 36/137
3,946,505 A * 3/1976 Dana, III ..... 362/103
4,033,243 A * 7/1977 Kirrish et al. ..... 411/338
4,050,167 A * 9/1977 Senter ..... 36/32 R
4,128,861 A * 12/1978 Pelengaris ..... 362/103
4,164,971 A * 8/1979 Strand ..... 411/301
4,202,117 A * 5/1980 Bidegain ..... 36/112
4,490,083 A * 12/1984 Rebish ..... 411/338
4,724,628 A * 2/1988 Schreiner ..... 36/136
4,805,320 A * 2/1989 Goldenberg et al. ..... 36/42
5,079,857 A * 1/1992 Clifton ..... 36/42
5,243,776 A * 9/1993 Zelinko ..... 36/134
5,244,326 A * 9/1993 Henriksen ..... 411/180
5,290,131 A * 3/1994 Henriksen ..... 411/180
5,371,662 A * 12/1994 Shen-Ko ..... 362/276
5,490,338 A * 2/1996 Hwang et al. ..... 36/137
5,549,234 A * 8/1996 Hong ..... 227/119
5,655,317 A * 8/1997 Grant ..... 36/134
5,926,980 A * 7/1999 Adam ..... 36/134
6,012,763 A * 1/2000 Clemente et al. ..... 296/186.4
6,115,946 A * 9/2000 Morris et al. ..... 36/115
6,345,472 B1 * 2/2002 Taylor ..... 52/125.4
6,354,231 B1 * 3/2002 Morris ..... 108/144.11
6,389,712 B1 * 5/2002 Schelling ..... 36/15

(Continued)

*Primary Examiner* — Khoa Huynh
*Assistant Examiner* — Timothy K Trieu
(74) *Attorney, Agent, or Firm* — Hansen IP Law PLLC

(57) ABSTRACT

A device for a shoe with a sole assembly including at least an outer sole and an insole connected to a heel through a shank and a heel breast. The device includes a cap comprising a cap head mounted to a hollow shaft with internal threads therein. The hollow shaft of the cap is received within a bore extending from the insole to the outer sole on the heel breast of the shoe between the heel and the shank of the shoe. A shank having a first end comprising threads and a second end. The first end of the shank is received by the hollow shaft of the cap to fasten the shank to the cap on the heal breast of the shoe.

12 Claims, 4 Drawing Sheets

(56) References Cited

U.S. PATENT DOCUMENTS

| | | | | |
|---|---|---|---|---|
| 6,434,870 | B1 * | 8/2002 | Fanjoy | 40/636 |
| 6,442,872 | B1 * | 9/2002 | Liao | 36/67 D |
| 6,481,122 | B2 * | 11/2002 | Brahler | 36/134 |
| 6,502,332 | B1 * | 1/2003 | Nakayama | 36/134 |
| 6,675,611 | B2 * | 1/2004 | Hunter | 63/3.1 |
| 6,698,986 | B2 * | 3/2004 | Fraleigh | 411/301 |
| 7,004,699 | B2 * | 2/2006 | Petrok et al. | 411/366.1 |
| 7,059,070 | B2 * | 6/2006 | Omstead et al. | 36/137 |
| 7,076,894 | B2 * | 7/2006 | Santos et al. | 36/134 |
| 7,578,075 | B1 * | 8/2009 | Kemp | 36/100 |
| 7,661,208 | B2 * | 2/2010 | McKinney et al. | 36/136 |
| 7,713,013 | B2 * | 5/2010 | Sedgwick et al. | 411/411 |
| 7,877,902 | B2 * | 2/2011 | Pieriboni | 36/100 |
| 7,987,619 | B2 * | 8/2011 | Mckinney et al. | 36/136 |
| 7,988,397 | B2 * | 8/2011 | Bodin et al. | 411/399 |
| 8,001,664 | B2 * | 8/2011 | Pearce | 24/681 |
| 8,069,583 | B1 * | 12/2011 | Simchuk | 36/15 |
| 8,210,785 | B1 * | 7/2012 | Gager | 411/429 |
| 2006/0026990 | A1 * | 2/2006 | Carter | 63/14.5 |
| 2006/0075662 | A1 * | 4/2006 | Schupbach | 36/100 |
| 2006/0180728 | A1 * | 8/2006 | Abrantes | 248/328 |
| 2008/0289076 | A1 * | 11/2008 | Millward | 2/69 |
| 2009/0249654 | A1 * | 10/2009 | Baucom et al. | 36/134 |
| 2010/0239386 | A1 * | 9/2010 | Sedgwick et al. | 411/402 |
| 2010/0289971 | A1 * | 11/2010 | Odland et al. | 348/801 |
| 2010/0307031 | A1 * | 12/2010 | Granito | 36/136 |
| 2011/0083341 | A1 * | 4/2011 | Baum | 36/100 |
| 2012/0137543 | A1 * | 6/2012 | Kemp | 36/100 |
| 2012/0186105 | A1 * | 7/2012 | Kemp et al. | 36/100 |

* cited by examiner

SHOE CHARM HOLDER DEVICE

BACKGROUND OF THE INVENTION

Field of the Invention

The invention pertains to the field of shoes. More particularly, the invention pertains to a holder device of charms on shoes.

SUMMARY OF THE INVENTION

A device for a shoe with a sole assembly includes at least an outer sole and an insole connected to a heel through a shank and a heel breast. The device includes a cap comprising a cap head mounted to a hollow shaft with internal threads therein. The hollow shaft of the cap is received within a bore extending from the insole to the outer sole on the heel breast of the shoe between the heel and the shank of the shoe. A shank having a first end comprising threads and a second end. The first end of the shank is received by the hollow shaft of the cap to fasten the shank to the cap on the heal breast of the shoe.

DETAILED DESCRIPTION OF THE INVENTION

Figure 1:
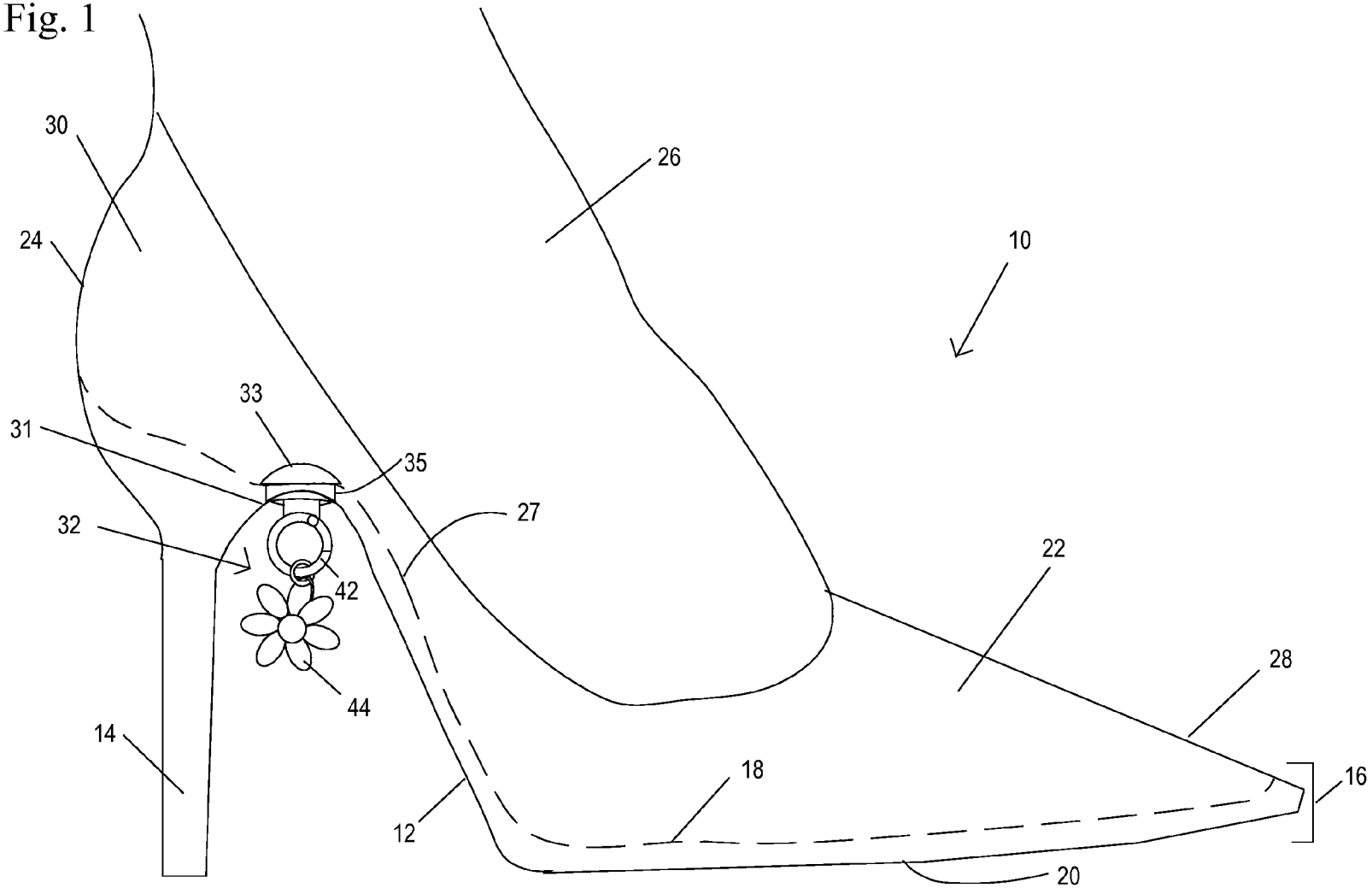
FIG. 1 shows a schematic of a shoe with a shoe charm holder device in an embodiment of the present invention.
Figure 6:
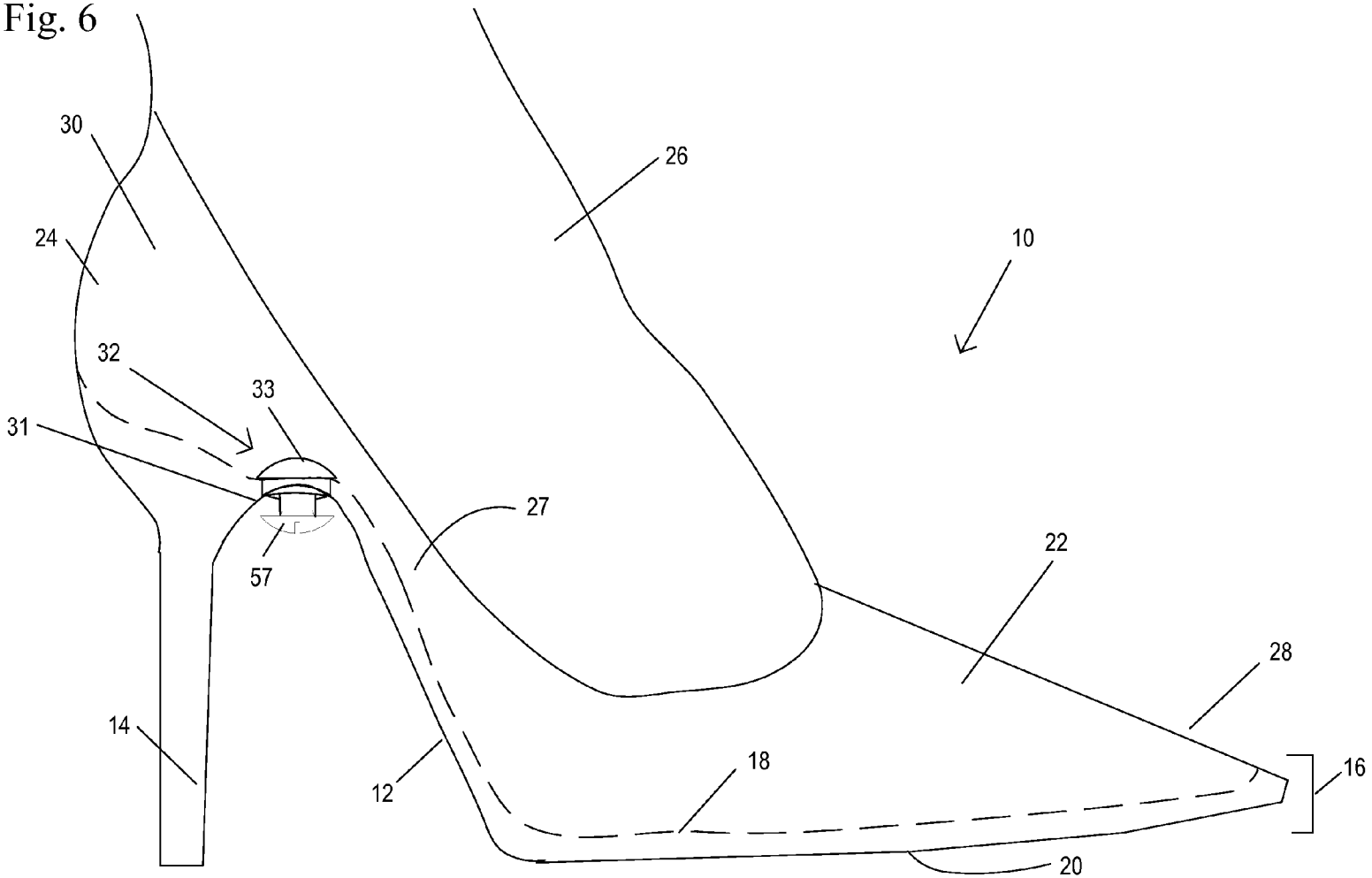
FIG. 6 shows a schematic of a shoe with a shoe charm holder device without the shoe charm.

As shown in FIGS. 1 and 6, a shoe 10 includes a shank 12 connected to a heel 14, through a heel breast 31 and a sole assembly 16. The shoe 10 also includes an upper covering of the toe region 22 and a counter 24 to support a heel of the wearer's foot 26. The sole assembly 16 includes an insole or inner sole 18 in the interior bottom of the shoe directly beneath the wearer's foot and an outer sole or outsole 20 in contact with the ground. The insole 18 is configured with the foot shape profile of the shoe with a toe end 28, connected to an arch profile 27 corresponding to the natural curvature of the foot's arch through to a heel end 30. The outsole 20 may be made of any suitable outsole material including, but not limited to leather, PVC, polyurethane, TPR, rubber or any combination thereof.

A bore 35 is present on the heel breast 31 between the shank 12 and the heel 14 of the shoe. The bore 35 extends from the insole 18 through the outsole 20. The bore 35 receives a portion of a holder device 32.

Figure 2:
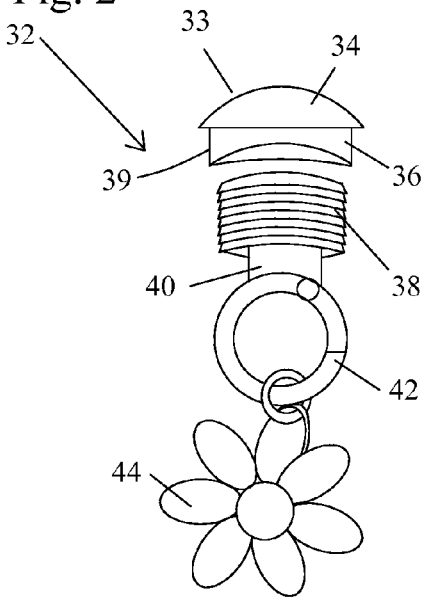
FIG. 2 shows a schematic of a shoe charm holder device of an embodiment in the present invention.
Figure 3:
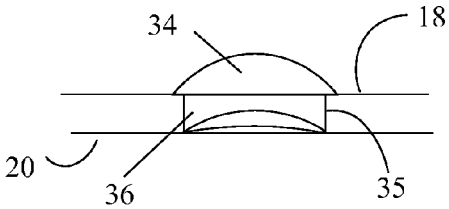
FIG. 3 shows a schematic of a cap of the shoe charm holder device in an insole of a shoe.
Figure 4:
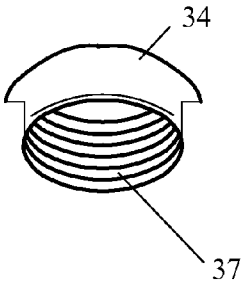
FIG. 4 shows a schematic of the internal threads of the cap in an embodiment in the present invention.

The holder device 32 has a hollow cap 33 received within the bore 35. The hollow cap 33 includes a cap head 34 mounted to a hollow shaft 36 with internal threads 37 as shown in FIGS. 2-4. The cap head 34 is preferably mounted perpendicular to the sides 39 of the hollow shaft 36 with internal threads 37. The hollow cap 33 is received within the bore 35 such that the hollow shaft 36 with internal threads 37 extends from the insole 18 to the outsole 20. The cap head 34 preferably has a diameter that is larger than the diameter of the bore 35, preventing the cap head 34 from moving from the insole 18 to the outsole 20 through the bore 35. The cap head 34 is preferably shaped such that the cap head 34 is unobtrusive to the wearer's foot. The cap head 34 may be a pan head, a button or dome head, a round head, or a truss head, or any other type of head that is unobtrusive to the wearer's foot.

The holder device 32 also includes a shank with a threaded portion 38 and an unthreaded portion 40 that is attached to a ring 42. Open and close ring shaped clasp 42 will attach to unthreaded portion 40 of male shank as one piece and is selectively openable to receive charm or ornament 44 and selectively closable to retain charm or ornament 44. Charm or ornament 44 is removably attached to the ring 42. The threaded portion 38 of the shank is received by shaft 36 with the internal threads 37 of the hollow cap 33, fastening the charm 44 to the hollow cap 33 and thus to the heel breast 31 present between the heel and the shank 12 of the shoe 10. While a ring 42 and a shank with threaded 38 and unthreaded 40 portions is shown to removably attach the charm 44, other means such as an eye screw could also be used without departing from the spirit of the invention. Additionally, the ring 42 may be removed and the charm or ornament directly attached to the shank. Furthermore, the charm or ornament 44 may be of any design that can be removably attached to the shank and is not limited to the design shown in the drawings.

Figure 5:
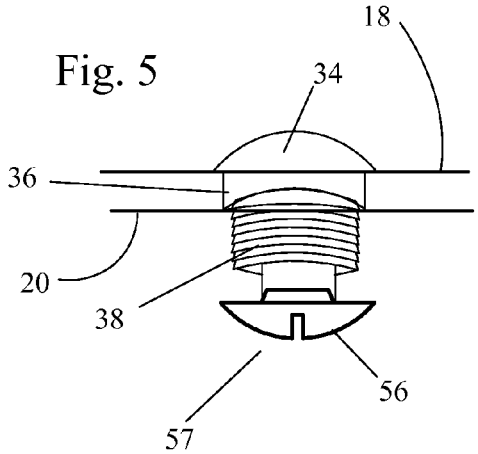
FIG. 5 shows the shoe charm holder device without the shoe charm.

Referring to FIGS. 5 and 6, when a wearer does not wish to have a charm 44 present on his/her shoe, a separate screw 56 with a head 57 that is easily turnable and shank 40 in which a portion is at least threaded 38, is received by the shaft 36 with internal threads 37 of the hollow cap 33 such that it would appear to be flat from the underside of the shoe. In one embodiment, the screw 56 is preferably a thumb screw.

While the threaded portion 38 of the shank and the unthreaded portion 40 of the shank are shown as having different diameters in the drawings, the threaded and unthreaded portions of the shank may also have the same diameter without departing from the spirit of the invention.

Figure 7:
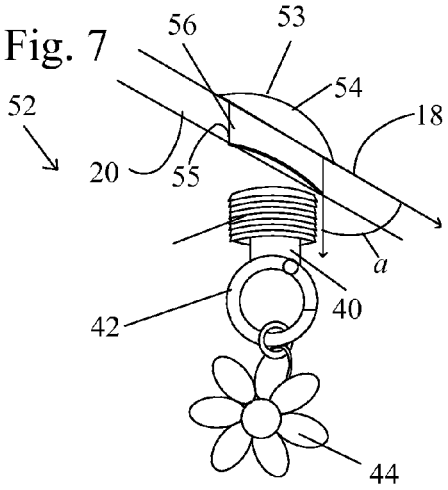
FIG. 7 shows a shoe charm holder device of a second embodiment in the present invention.

FIG. 7 shows a schematic of a shoe charm holder device 52 in a second embodiment. In this embodiment, the cap head 54 is placed at an acute angle a relative to at least one side 55 of the shaft 56 with internal threads 37. As in the first embodiment, the shaft 56 with internal threads 37 of the hollow cap 53 receives a threaded portion of the shank 38 connected to an unthreaded portion 40 attached to a ring 42 with a charm 44. The cap head 54 preferably has a diameter that is larger than the diameter of the bore 35, preventing the cap head 54 from moving from the insole 18 to the outsole 20 through the bore 35. The cap head 54 is preferably shaped such that the cap head 54 is unobtrusive to the wearer's foot. The cap head 54 may be a pan head, a button or dome head, a round head, a truss head, or any other type of head that is unobtrusive to the wearer's foot. Additionally, the ring 42 may be removed and the charm or ornament directly attached to the shank.

Figure 8:
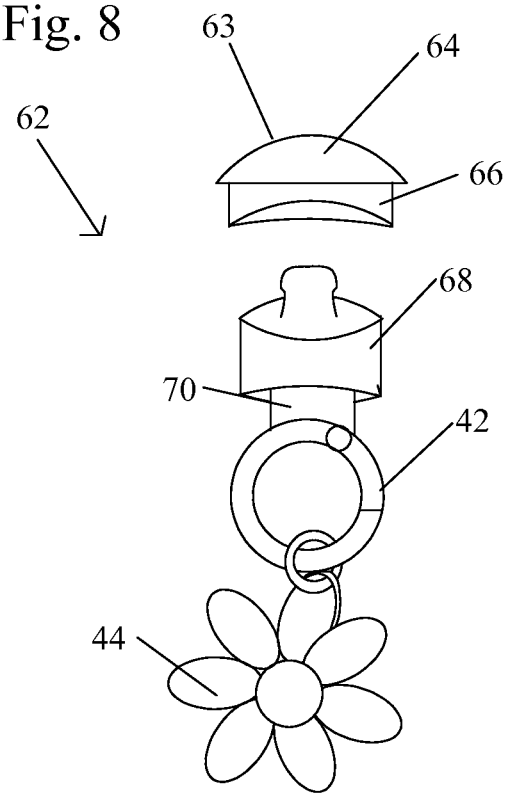
FIG. 8 shows a shoe charm holder device of a third embodiment in the present invention.

FIG. 8 shows a schematic of a shoe charm holder device 62 in a third embodiment. In this embodiment, the hollow cap 63 includes a cap head 64 connected to a socket 66. The socket 66 receives a stud 68 attached to a shank 70 mounted to a ring 42 with a removable charm 44 and snaps the charm 44 onto the shoe 10 at the heel breast 31 located between the heel 14 and the shank 12 of the shoe 10. As in the first embodiment, the hollow cap 63 is received within a bore 35 that extends from the insole 18 through to the outsole 20 of the shoe 10.

Additionally, the ring 42 may be removed and the charm or ornament directly attached to the shank.

While the shoe in FIGS. 1 and 6 are shown with an upper covering 22 of the toe region of a wearer's foot and a counter 24 to support the heel of a wearer, the shoe may alternatively just have straps on the toe region and/or around the heel.

The shoe 10 in which the shoe charm holder device is installed preferably has a heel that is at least 0.5 inches above the ground or greater and preferably includes, but is not limited to kitten heels, high heels, and stilettos.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A shoe comprising a charm holder device and a sole assembly, the sole assembly including at least an outer sole adapted to contact the ground when in use and an insole adapted to contact the bottom of a user's foot when in use connected to a heel through a shoe shank and a heel breast, the sole assembly having a bore through and extending from the insole to the outer sole on the heel breast between the heel and the shoe shank, wherein the bore is oriented vertically with respect to the ground when the outer sole is in contact with the ground, and the charm holder device comprises:

a cap comprising a cap head mounted to a hollow shaft with internal threads therein, the hollow shaft of the cap being received within the bore; and a charm holder device shank having a first end comprising threads and a second end, wherein the first end of the charm holder device shank is received by the hollow shaft of the cap to fasten the charm holder device shank to the cap on the heel breast of the shoe.

2. The device of claim 1, wherein the cap head of the cap has a diameter larger than a diameter of the bore.

3. The device of claim 1, wherein the cap head is mounted perpendicular to sides of the hollow shaft.

4. The device of claim 1, wherein the cap head is mounted at an acute angle to at least one side of the hollow shaft.

5. The device of claim 1, wherein the second end is fastened to a charm or ornament.

6. The device of claim 1, wherein the second end is a screw head.

7. The device of claim 1, wherein the second end is a loop.

8. The device of claim 1, wherein the heel is at least 0.5 inches high.

9. A shoe comprising a charm holder device and a sole assembly including at least an outer sole adapted to contact the ground when in use and an insole adapted to contact the bottom of a user's foot when in use connected to a heel through a shoe shank and a heel breast, the sole assembly having a bore through and extending from the insole to the outer sole on the heel breast between the heel and the shoe shank, wherein the bore is oriented vertically with respect to the ground when the outer sole is in contact with the ground, and the charm holder device comprises:

a cap comprising a cap head mounted to a shaft with an internal female socket, the shaft of the cap being received within the bore; and a charm holder device shank having a first end with a male stud and a second end, wherein the first end comprising the male stud of the charm holder device shank is received by the female socket of the shaft to fasten the charm holder device shank to the cap on the heel breast of the shoe.

10. The device of claim 9, wherein the second end is fastened to a charm or ornament.

11. The device of claim 9, wherein the second end is a screw head.

12. The device of claim 9, wherein the head of the cap has a diameter larger than a diameter of the bore.

* * * * *